US009388613B2

(12) United States Patent
Kamin et al.

(10) Patent No.: US 9,388,613 B2
(45) Date of Patent: Jul. 12, 2016

(54) LATCH ASSEMBLY FOR MULTIPLE DOORS

(71) Applicant: CompX International Inc., Greenville, SC (US)

(72) Inventors: John Y. Kamin, Taylors, SC (US); Timothy J. Peters, Palatine, IL (US)

(73) Assignee: CompX International Inc., Greenville, SC (US)

( * ) Notice: Subject to any disclaimer, the term of this patent is extended or adjusted under 35 U.S.C. 154(b) by 2 days.

(21) Appl. No.: 14/336,080

(22) Filed: Jul. 21, 2014

(65) Prior Publication Data

US 2015/0022070 A1 Jan. 22, 2015

Related U.S. Application Data

(60) Provisional application No. 61/857,064, filed on Jul. 22, 2013.

(51) Int. Cl.

| | |
|---|---|
| ***E05C 19/02*** | (2006.01) |
| ***E05C 1/08*** | (2006.01) |
| ***E05B 65/44*** | (2006.01) |
| ***E05C 7/06*** | (2006.01) |
| *E05B 15/04* | (2006.01) |

(52) U.S. Cl.

CPC ..... *E05C 19/028* (2013.01); *E05B 65/44* (2013.01); *E05C 1/08* (2013.01); *E05C 7/06* (2013.01); *E05B 15/04* (2013.01); *Y10T 292/0817* (2015.04)

(58) Field of Classification Search

CPC ..... E05B 15/04; E05B 55/12; E05B 63/24
USPC ..... 70/208, 210, 118, 145, 224, 467; 292/3, 292/150

See application file for complete search history.

(56) References Cited

U.S. PATENT DOCUMENTS

| | | | | | |
|---|---|---|---|---|---|
| 1,013,553 | A | * | 1/1912 | Johnson | E05C 19/028 292/16 |
| 2,489,154 | A | * | 11/1949 | Relton | E05C 19/16 292/251.5 |
| 4,179,143 | A | * | 12/1979 | Shy | 292/179 |
| 4,235,463 | A | | 11/1980 | Benevenuta | |
| 4,457,146 | A | | 7/1984 | Weinerman | |
| 4,703,981 | A | | 11/1987 | Stewart | |
| 4,793,643 | A | | 12/1988 | Ahad et al. | |
| 5,078,437 | A | | 1/1992 | Borgmeyer et al. | |

(Continued)

*Primary Examiner* — Kristina Fulton
*Assistant Examiner* — Thomas Neubauer
(74) *Attorney, Agent, or Firm* — Dority & Manning, P.A.

(57) ABSTRACT

A self-contained latch module in combination with a pusher and catch (collectively "latch assembly") allows for the locking of two doors with a single lock. The latch module contains two spring-loaded bolts, one active and one passive. Pushing the active bolt into the latch housing, the passive bolt extends out of the opposite side of the latch housing. Pushing onto the passive bolt in the direction of the latch housing while the active bolt is depressed will allow the passive bolt to retract into the housing without affecting the active bolt on the opposite side. This allows a user to slam closed the associated doors in any order. The self-latching nature of this latch assembly allows for the automatic latching of the cabinet doors without having to manually latch one of the doors before locking the other. In the case of tall wardrobe doors, it is desirable to install two latch assemblies; one at the top and another at the bottom, with the lock installed in the center position of the door, thereby preventing the prying of the doors. The latch assembly is mountable at the top and/or bottom of a cabinet or wardrobe, and is field retrofitable.

16 Claims, 13 Drawing Sheets

(56) References Cited

U.S. PATENT DOCUMENTS 5,570,912 A * 11/1996 Mullich ..... 292/1.5
6,023,953 A * 2/2000 Vickers et al. ..... 70/208
6,120,071 A 9/2000 Picard et al.
6,729,701 B2 5/2004 Carter et al.
7,458,621 B2 12/2008 Fujihara et al.
8,888,147 B2 * 11/2014 Blanck et al. ..... 292/34
2005/0127692 A1 * 6/2005 Sanders ..... 292/340

* cited by examiner

| COMBINATION # | LOCATION OF LOCK ON CABINET | POSITION OF LATCH MODULE IN CABINET | LATCH MODULE TYPE |
|---|---|---|---|
| 1 | LEFT DOOR | BOTTOM | A |
| 2 | LEFT DOOR | TOP | B |
| 3 | RIGHT DOOR | BOTTOM | B |
| 4 | RIGHT DOOR | TOP | A |
| 5 | LEFT DOOR | 1 AT BOTTOM | A |
| | | 1 AT TOP | B |
| 6 | RIGHT DOOR | 1 AT BOTTOM | B |
| | | 1 AT TOP | A |

Fig. 25

LATCH ASSEMBLY FOR MULTIPLE DOORS

PRIORITY CLAIM

This application claims the benefit of previously filed U.S. Provisional Patent Application entitled "THREE POINT LATCH," assigned U.S. Ser. No. 61/857,064, filed Jul. 22, 2013, and which is incorporated herein by reference for all purposes.

FIELD OF THE DISCLOSURE

The present disclosure relates to a latching mechanism in applications where it is desirable to lock two doors using a single lock.

BACKGROUND OF THE DISCLOSURE

In certain applications and environments it is desirable to lock two doors with a single lock situated at the center of one of the doors. In those instances there exist many types of latches that allows for the latching of the door opposite the lock. One such latch is a manual slide action latch that requires the user to reach behind the door and manually latch or unlatch the door opposite the lock. In another example, a latch will automatically actuate when the door with the lock on it closes, thereby latching the opposite door. In both such cases, the door opposite the lock needs to be closed first. In the latter case, closing first the door with the lock and then the opposite door will result in a crash (physical contact) involving the latch that may damage the latch mechanism and possibly the furniture (or other associated structure).

A variety of approaches have been previously published relating to consideration of locking or latching plural doors, involving or not a center post or similar. Examples include U.S. Pat. No. 7,458,621 to Fujihara et al. entitled Door connector; U.S. Pat. No. 6,729,701 to Carter et al. entitled Safety cabinet; U.S. Pat. No. 6,120,071 to Picard et al. entitled Mortise latch vertical rod exit device; U.S. Pat. No. 5,078,437 to Borgmeyer et al. entitled Transformer having an integral cabinet with door latching and locking apparatus; U.S. Pat. No. 4,793,643 to Ahad et al. entitled Door closing and locking mechanism; U.S. Pat. No. 4,703,981 to Stewart entitled Collapsible cabinet; U.S. Pat. No. 4,457,146 to Weinerman entitled Sliding door lock; and U.S. Pat. No. 4,235,463 to Benevenuta entitled Closure device for container doors. The complete disclosures of the foregoing listings are incorporated herein by reference, for all purposes.

The present disclosure offers a solution for such problems which allows the doors to be closed in any order (including both doors simultaneously) without a crash and with automatic latching.

SUMMARY OF THE DISCLOSURE

In view of the recognized features encountered in the prior art and addressed by the presently disclosed subject matter, improved apparatus and corresponding methodology therefor have been provided for improved lock closures. More particularly, the presently disclosed subject matter relates to automatic latching upon closure of the associated doors.

In certain broader present aspects, it is a present object to provide latching features for applications to allow for the locking of two doors using a single lock.

In certain aspects, another more particular present object of various present exemplary forms in accordance with presently disclosed subject matter is to allow a user to slam closed associated doors in any order. More specifically, it an object for some presently disclosed embodiments to offer a latching solution to allow doors to be closed in any order including the closing of multiple doors simultaneously, without a crash but with automatic latching.

Another present broader object of various of the presently disclosed exemplary embodiments is to provide devices that have a self-latching nature so that the resulting latch assembly allows for the automatic latching of the cabinet doors without having to manually latch one of the doors before locking the other.

In accordance with further broader objects, aspects, and advantages of certain embodiments of the present subject matter, methodologies are provided which advantageously allow for multiple configurations. As one example, in the case of tall wardrobe doors, the presently disclosed subject matter allows for installation of two latch assemblies, one at the top and another at the bottom, with the lock installed in the center position of the door, thereby preventing the prying of the doors. Further, embodiments of the presently disclosed subject matter may be mountable at the top and/or bottom of a cabinet or wardrobe or other similar enclosure.

Another present broader object of various of the presently disclosed exemplary embodiments is to provide devices that may be field retrofitable for use with an existing structure, or which may be originally installed with newly manufactured components.

In accordance with yet additional objects, aspects, and advantages of further exemplary embodiments of the present subject matter, apparatus and accompanying and corresponding methodologies are provided for practice in accordance with the presently disclosed structures, devices, and combinations thereof.

One present exemplary embodiment relates to a latch assembly for multiple doors of an enclosure. Such an exemplary latch assembly preferably comprises a pusher engagement member for mounting on a first associated door of an associated enclosure; a catch engagement member for mounting on a second associated door of an associated enclosure; and a housing defining an interior chamber along an elongated axis of such housing. Further, such exemplary latch assembly preferably also comprises a pair of sliding spring-loaded bolts comprising respective bolt and spring pairs received in axial alignment for slide movement in such interior chamber with such bolts in partially nested position, such that an active bolt of such pair of bolts engages and pushes outwardly away from such housing a passive bolt of such pair of bolts whenever such active bolt is engaged by such pusher engagement member for relatively inward movement of such active bolt relative to such housing, so that such passive bolt is in a relatively extended position relative to such housing to engage such catch engagement member whenever the second associated door of the associated enclosure is in a closed position.

In variations of such exemplary latch assembly, such passive bolt may be mounted for inward sliding movement along such interior chamber relative to such housing whenever such passive bolt is engaged by such catch engagement member, without moving such active bolt.

In other variations of the foregoing, such interior chamber may comprise a u-shaped channel formed by such housing; and such latch assembly may further include a cap plate for selectively enclosing such u-shaped channel for maintaining such springs and inward ends of such bolts in such interior chamber.

Per other alternatives of the foregoing, such bolts may have respective outward ends forming angled surfaces for contact with such engagement members for respectively being driven by such engagement members in an inward direction relative to such housing; and such bolts may have respective inward ends forming pins disposed for securing respective ends of their paired springs.

In yet other alternatives, an exemplary latch assembly in some embodiments may further comprise a pair of mating stop members formed respectively on such active bolt and such passive bolt for limiting the range of inward movement of such active bolt.

For still other alternatives, a presently disclosed latch assembly in some implementations may further comprise a pair of cradles formed in such interior chamber for respectively receiving such pair of springs in parallel, non-axial alignment.

In other presently disclosed alternative arrangements, a latch assembly may further include a lock for mounting relative to the associated enclosure for locking the first and second associated doors whenever such doors are closed.

Still other variations may comprise a latch assembly wherein such interior chamber may comprise a u-shaped channel formed by such housing, with such passive bolt mounted therein for inward sliding movement along such interior chamber relative to such housing whenever such passive bolt is engaged by such catch engagement member, without moving such active bolt; such bolts may have respective outward ends forming angled surfaces for contact with such engagement members for respectively being driven by such engagement members in an inward direction relative to such housing; and such bolts may have respective inward ends forming pins disposed for securing respective ends of their paired springs. Further, such alternative latch assembly may further include a cap plate for selectively enclosing such u-shaped channel for maintaining such springs and inward ends of such bolts in such interior chamber; a pair of mating stop members formed respectively on such active bolt and such passive bolt for limiting the range of inward movement of such active bolt; and a pair of cradles formed in such interior chamber for respectively receiving such pair of springs in parallel, non-axial alignment.

Yet another presently disclosed exemplary embodiment relates to a latch assembly for mounting on a cabinet having at least respective paired first and second doors. Such exemplary latch assembly preferably comprises respective pusher and catch members for respective mounting on such first and second doors; and a latch module. Such latch module is preferably for mounting on such cabinet between such pusher and catch members, and having a housing defining an interior chamber along an elongated axis of such housing, and having a pair of slam bolts received in such interior chamber for respective closing engagement of such bolts depressed into such latch module housing whenever respectively engaged by such pusher and catch members. Further, preferably, such bolts are partially nested relative to each other so that depressing one bolt into such latch housing extends the other bolt out of the opposite side of the latch module housing while depressing such other bolt into such latch housing passes by the one bolt without changing position of such one bolt in such latch module housing.

Exemplary variations of such latch assembly may further comprise a pair of mating stop members formed respectively on such bolts for limiting the range of depressing movement of such one bolt into such latch module housing. In others, such slam bolts may be respectively associated with springs received within such latch module housing. In still others, such latch assembly may further comprise a u-shaped channel formed by such latch module housing and forming such interior chamber thereof; and may further include a cap plate for selectively closing such u-shaped channel for maintaining such springs and inward ends of such bolts in such interior chamber.

In yet other present alternatives of such latch assembly embodiments, such bolts may have respective outward ends forming angled surfaces for contact with such pusher and catch members for respectively being depressed by such pusher and catch members into such latch module housing; and such bolts may also have respective inward ends forming pins disposed for securing respective ends of their associated springs.

In still other variations, such exemplary latch assembly embodiments may in some instances further comprise a pair of cradles formed in such interior chamber for respectively receiving such pair of springs in parallel, non-axial alignment.

In others of the foregoing, they may further include a lock for mounting relative to the associated enclosure for locking the first and second associated doors whenever such doors are closed.

Still others of the foregoing may further include a second set of respective pusher and catch members for respective mounting on such first and second doors; and a second latch module for mounting on such cabinet between such second set of respective pusher and catch members.

It is intended to be understood by those of ordinary skill in the art from the complete disclosure herewith that the presently disclosed subject matter equally relates to apparatus as well as corresponding and/or related methodologies. One exemplary presently disclosed methodology relates to subject matter for locking a cabinet having at least respective paired first and second doors. Such methodology preferably comprises mounting respective pusher and catch members on the respective first and second doors; and mounting a latch module on the cabinet between the pusher and catch members. Preferably, such latch module has a housing defining an interior chamber along an elongated axis of such housing, and has a pair of slam bolts received in such interior chamber for respective closing engagement of such bolts depressed into such latch module housing whenever respectively engaged by such pusher and catch members. Further, preferably, such bolts are partially nested relative to each other so that depressing one bolt into such latch housing extends the other bolt out of the opposite side of the latch module housing while depressing such other bolt into such latch housing passes by the one bolt without changing position of such one bolt in such latch module housing.

In some embodiments of the foregoing, such exemplary methodology may optionally further include mounting a lock on the cabinet for selectively locking the first and second associated doors whenever such doors are closed, whereby two respective doors are locked by a single lock.

In other present alternatives, a pair of mating stop members may be formed respectively on such bolts for limiting the range of depressing movement of such one bolt into such latch module housing.

In still other present variations of presently disclosed methodology, such slam bolts may be respectively associated with springs received within such latch module housing; such bolts may have respective outward ends forming angled surfaces for contact with such pusher and catch members for respectively being depressed by such pusher and catch members into such latch module housing; and such bolts may have respective inward ends forming pins disposed for securing respective ends of their associated springs.

In yet other variations of presently disclosed methodology, steps may be included for further including providing a second set of respective pusher and catch members respectively mounted on such first and second doors; and providing a second latch module mounted on such cabinet between such second set of respective pusher and catch members.

In certain alternative arrangements of presently disclosed subject matter involving a lock, such first and second doors may be relatively elongated and such latch modules may be spaced at a distance relative to each other, and such lock may be mounted in a central location relative to such two spaced latch modules.

Additional objects and advantages of the presently disclosed subject matter are set forth in, or will be apparent to, those of ordinary skill in the art from the detailed description herein. Also, it should be further appreciated that modifications and variations to the specifically illustrated, referred and discussed features, elements, and steps hereof may be practiced in various embodiments and uses of the presently disclosed subject matter without departing from the spirit and scope of the subject matter. Variations may include, but are not limited to, substitution of equivalent means, features, or steps for those illustrated, referenced, or discussed, and the functional, operational, or positional reversal of various parts, features, steps, or the like.

Still further, it is to be understood that different embodiments, as well as different presently preferred embodiments, of the presently disclosed subject matter may include various combinations or configurations of presently disclosed features, steps, or elements, or their equivalents including combinations of features, parts, or steps or configurations thereof not expressly shown in the figures or stated in the detailed description of such figures. Additional embodiments of the presently disclosed subject matter, not necessarily expressed in the summarized section, may include and incorporate various combinations of aspects of features, components, or steps referenced in the summarized objects above, and/or other features, components, or steps as otherwise discussed in this application. Those of ordinary skill in the art will better appreciate the features and aspects of such embodiments, and others, upon review of the remainder of the specification.

BRIEF DESCRIPTION OF THE DRAWINGS

A full and enabling disclosure of the presently disclosed subject matter, including the best mode thereof, directed to one of ordinary skill in the art, is set forth in the specification, which makes reference to the appended figures, in which:

FIG. 25 is a summary table of different configurations of the presently disclosed subject matter in use with a cabinet.

Figure 1:
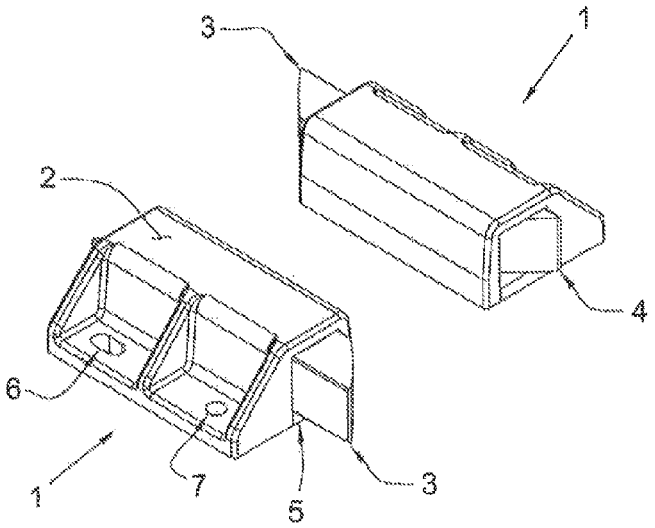
FIG. 1 shows two perspective views, one from the front and the second from the back, showing an exemplary embodiment of a presently disclosed latch module in an assembled state.

Repeat use of reference characters throughout the present specification and appended drawings is intended to represent same or analogous features, elements, or steps of the present subject matter.

DETAILED DESCRIPTION OF THE PREFERRED EMBODIMENTS

Figure 2:
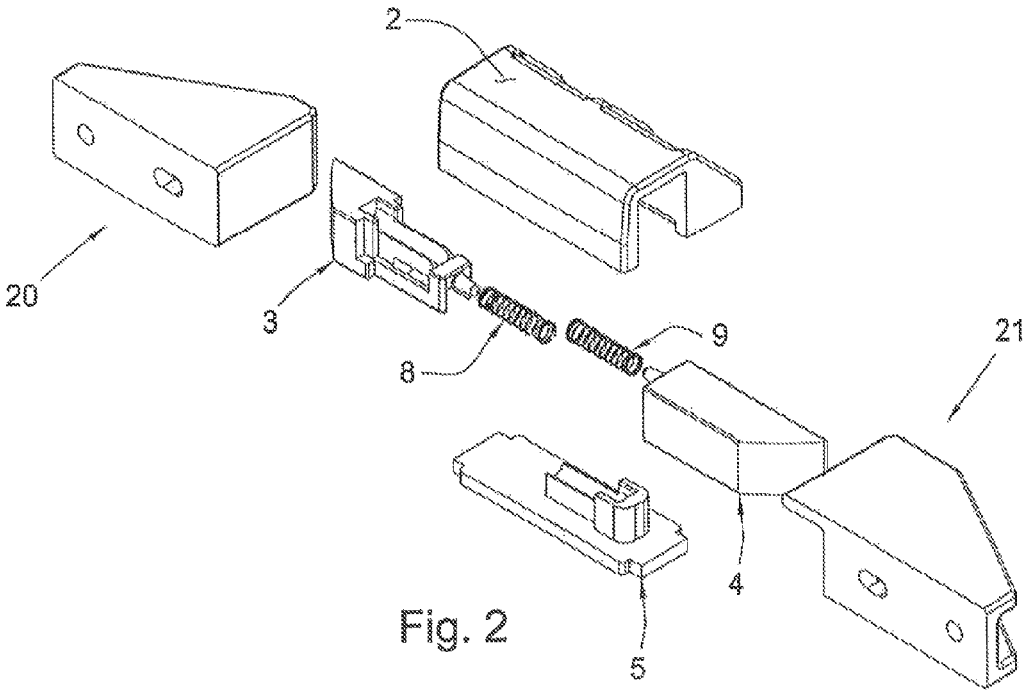
FIG. 2 is a perspective exploded view showing all of the components of the exemplary presently disclosed latch module, pusher and catch, collectively "latch assembly"

Referring to FIG. 1, an exemplary embodiment of a presently disclosed latch module 1 includes a housing 2, an active bolt 3, a passive bolt 4, and a cap 5. In addition, FIG. 2 shows internal components of the presently disclosed module 1 which includes two springs, including one active bolt spring 8 and one passive bolt spring 9. FIG. 2 also shows a pusher 20 which serves to actuate the active bolt 3, and a catch 21 which latches onto the passive bolt 4. The method of attachment of the latch module 1, pusher 20, and catch 21 is described in further detail herein.

Figure 3:
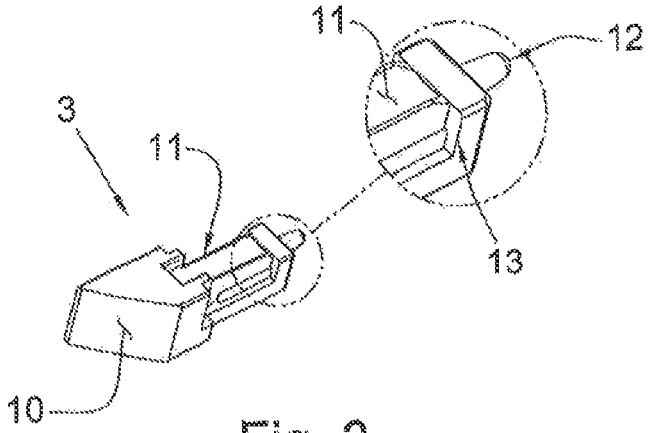
FIG. 3 is a perspective view of an active bolt.

FIG. 3 shows an exemplary presently disclosed active bolt 3. At the tip of the bolt 3 a ramped surface 10 provides a means for pusher 20 to actuate the bolt 3 in a direction perpendicular to the motion of the pusher 20. Behind the ramped surface 10 a concave surface 11 forms a cradle for the passive bolt spring 9 to lie in, thereby restraining the side-to-side motion of such spring 9. At the opposite end of the active bolt 3, a pin 12 is disposed to anchor the end of the active spring 8. In either side of pin 12, a stop surface 13 is disposed to correspond to a mating stop surface 14 in the passive bolt 4 in FIG. 4. The stop surfaces 13 and 14, respectively, restrain the active bolt within the module and provide for a limit of forward travel of the bolt 3.

Figure 4:
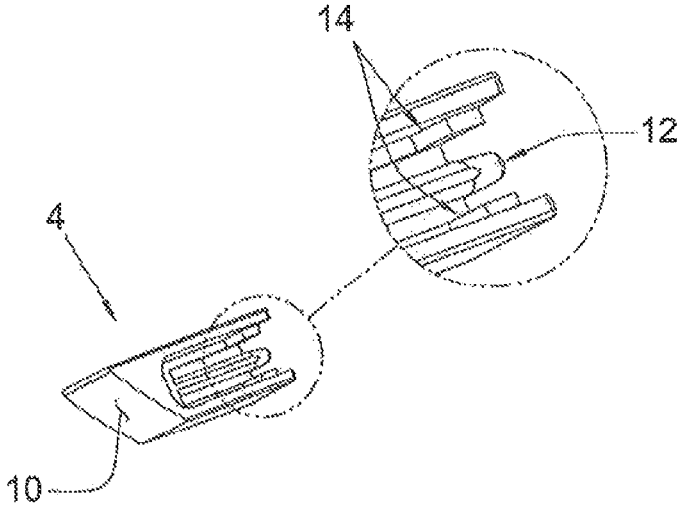
FIG. 4 is a perspective view of a passive bolt.

FIG. 4 further shows exemplary details of a presently disclosed passive bolt 4. At the tip of the bolt 4, a ramped surface 10 (identical to the ramped surface 10 of the active bolt 3) provides a means for the catch 21 to actuate the bolt 4 in a direction perpendicular to the motion of the catch 21. A pin 12 is disposed at the opposite end of the bolt 4 to anchor the end of the passive spring 9. Pin 12 in passive bolt 4 is identical to pin 12 in active bolt 3.

Figure 5:
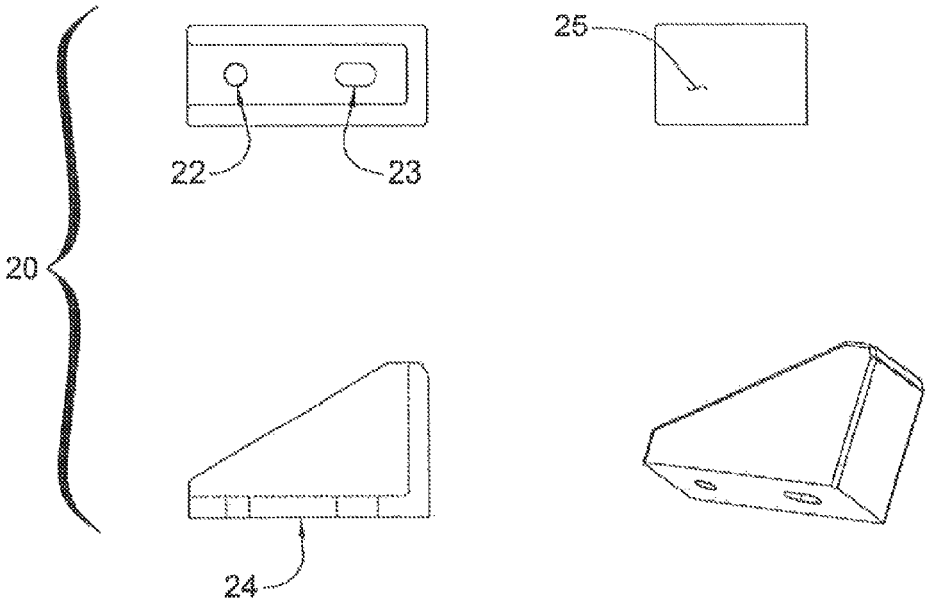
FIG. 5 shows three standard views along with a perspective view of a pusher.

FIG. 5 shows three standard views and a perspective view (bottom right quadrant of FIG. 5) of the pusher 20. In the rear view (top left quadrant of FIG. 5), a hole 22 and slot 23 are provided for mounting the pusher 20 to the associated door. In the top/bottom view (bottom left quadrant of FIG. 5), 24 is the surface that is mounted against the associated door. In the side view (upper right quadrant of FIG. 5), 25 is the surface that serves to actuate the active bolt 3.

Figure 6:
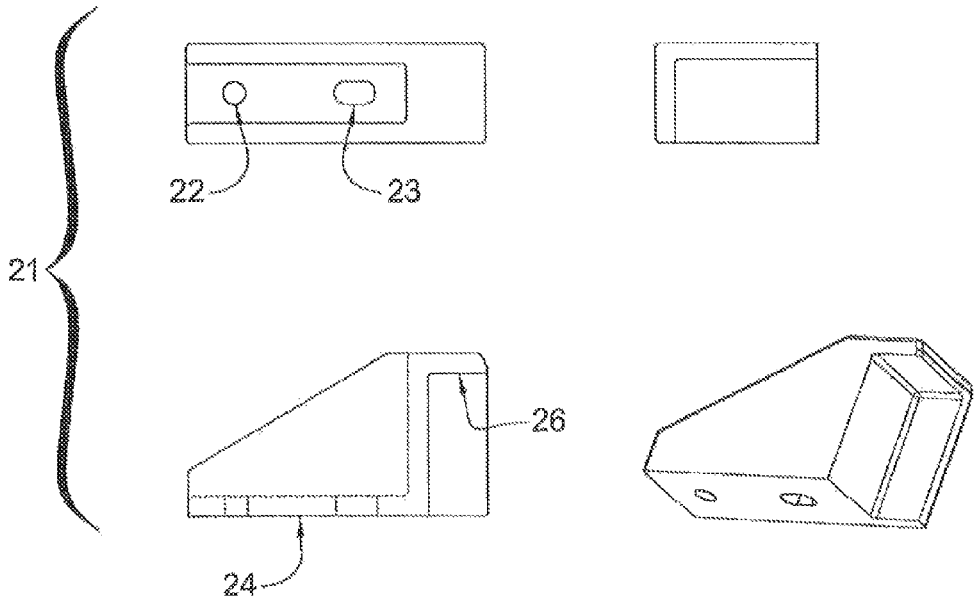
FIG. 6 shows three standard views along with a perspective view of a catch.

FIG. 6 shows three standard views and a perspective view (bottom right quadrant of FIG. 6) of the catch 21. In the rear view (top left quadrant of FIG. 6), a hole 22 and slot 23 are provided for mounting the catch 21 to the associated door. In the top/bottom view (bottom left quadrant), 24 is the surface that is mounted against the associated door and 26 is the surface that catches behind the passive bolt 4 to latch the door closed. The upper right quadrant of FIG. 6 illustrates a side view of catch 21.

Figure 7:
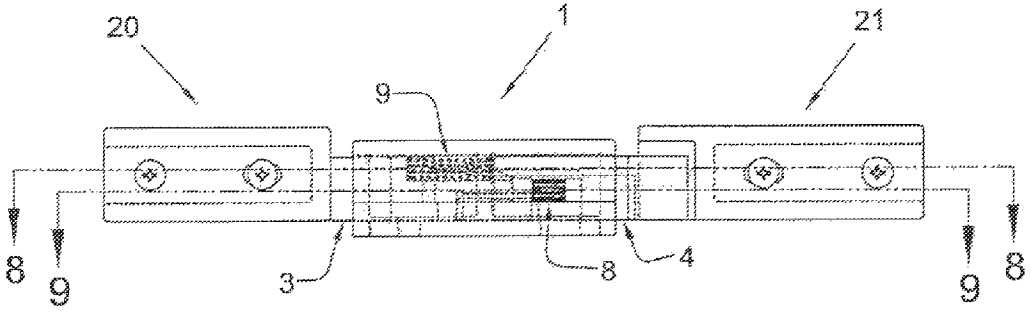
FIG. 7 is a rear view showing the latch assembly, including a latch module, pusher, and catch.

FIG. 7 is a rear view showing the latch module 1 with pusher 20 actuating the active bolt 3 and catch 21 latched behind the passive bolt 4. Section line 8-8 is taken through the passive bolt spring 9 and section line 9-9 is taken through the active bolt spring 8.

Figure 8:
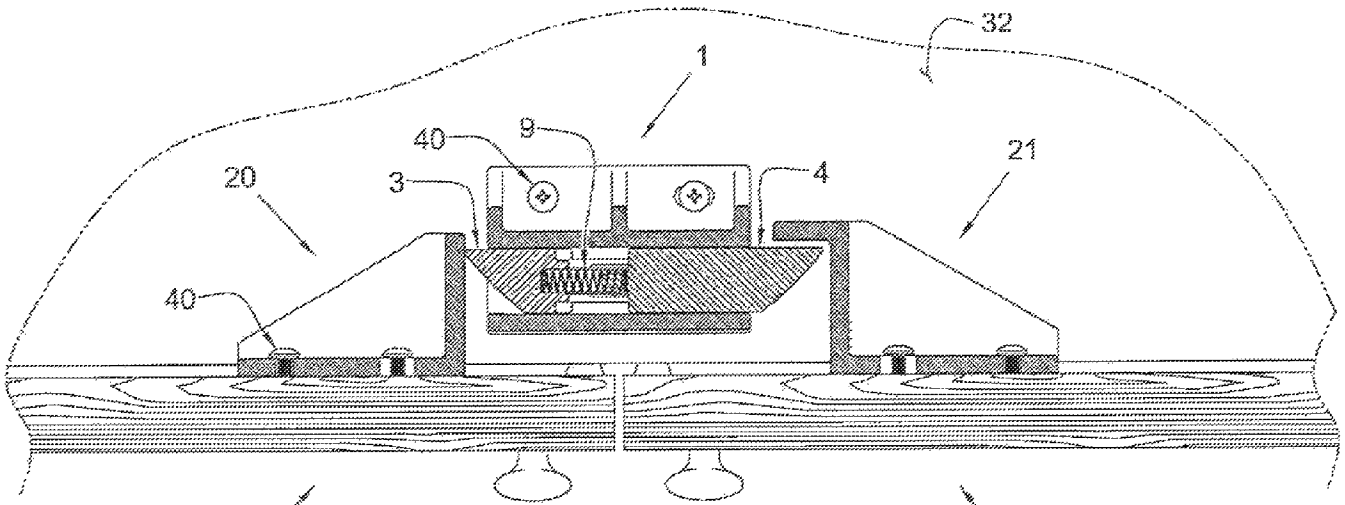
FIG. 8 is a section view of the presently disclosed latch assembly taken along section line 8-8 (through the passive bolt spring) in FIG. 7, and illustrating internal components of such exemplary presently disclosed latch module.

FIG. 8 is a section view taken along section line 8-8 in FIG. 7. The respective associated cabinet doors 30 & 31 are shown closed, with the pusher 20 mounted to the left door 30 and with catch 21 mounted to the right door 31 using suitable attachment elements such as screws 40. Furthermore, the latch module 1 is situated between the pusher 20 and catch 21 and is likewise attached to the frame of the cabinet 32 using screws 40 or equivalent. The active bolt 3 is actuated, and through the force of the passive bolt spring 9 the passive bolt is extended underneath the latching surface 26 of the catch 21, thereby latching the right door 31 closed.

Figure 9:
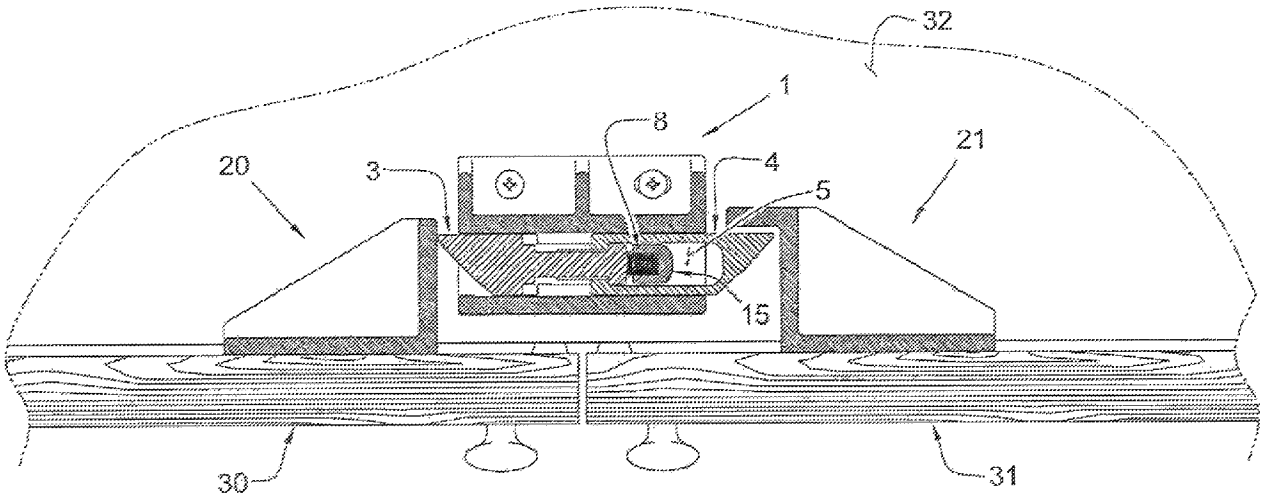
FIG. 9 is a section view of the presently disclosed latch assembly taken along section line 9-9 (through the active bolt spring) in FIG. 7, and illustrating internal components of such exemplary presently disclosed latch module.

FIG. 9 is a section view taken along section line 9-9 in FIG. 7. The respective associated cabinet doors 30 & 31 are shown closed. Pusher 20 is illustrated as actuating the active bolt 3 which in turn compresses the active bolt spring 8 against the spring stop 15 in the cap 5.

Figure 10:
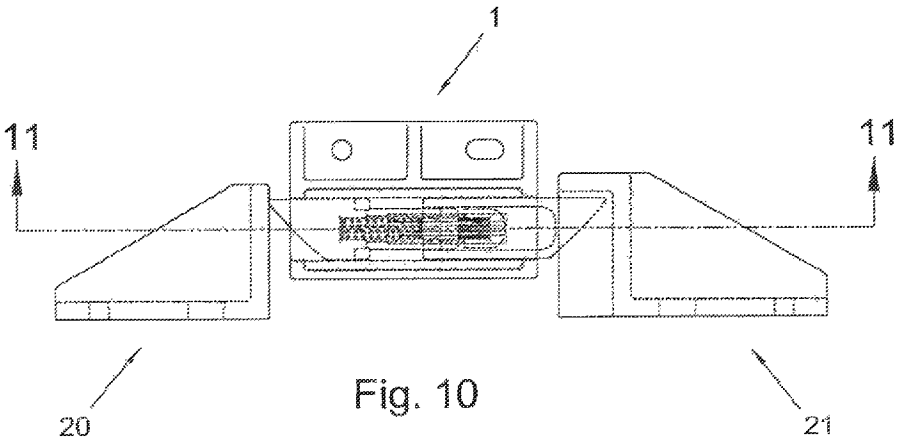
FIG. 10 is a top view showing the latch assembly, including a latch module, pusher, and catch.

FIG. 10 is a top view showing the latch module 1, pusher 20, and catch 21 with section line 11-11 taken through both active and passive bolt springs 8 and 9, respectively.

Figure 11:
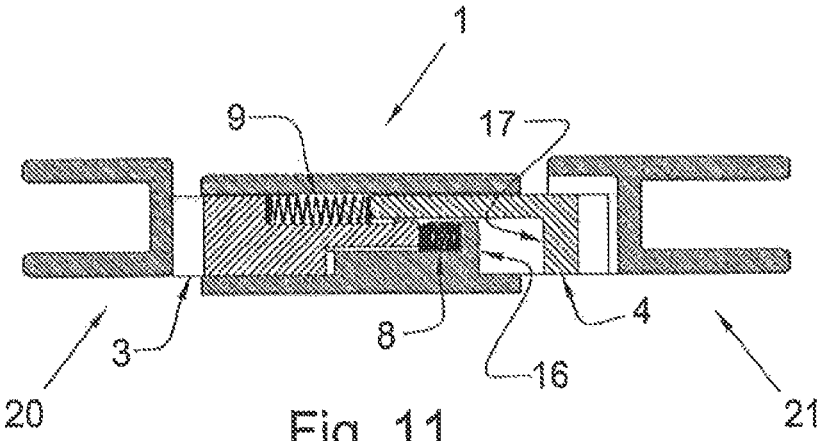
FIG. 11 is a section view of the presently disclosed latch assembly taken along section line 11-11 (through both the passive and active bolt springs) in FIG. 10, and illustrating internal components of such exemplary presently disclosed latch module, with the active bolt retracted by the pusher and the active bolt spring compressed.

FIG. 11 is a section view taken along section line 11-11 in FIG. 10. The passive bolt spring 9 is shown extended as there is no obstruction to the passive bolt 4, and the active bolt spring 8 is shown compressed by the active bolt 3 which is acted upon by the pusher 20. Surfaces 16 and 17 collectively act as a positive stop to prevent the passive bolt 4 from extending too far into the latch module 1.

Figure 12:
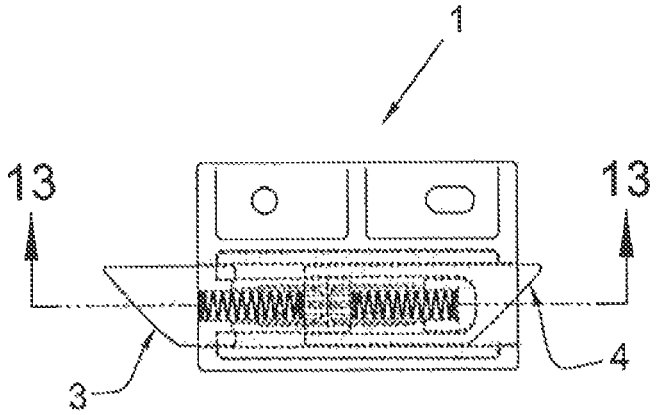
FIG. 12 is a top view of the presently disclosed latch module showing neutral state of the bolts and springs.

FIG. 12 is a top view of the latch module 1 in its neutral state with the active bolt 3 extended and the passive bolt 4 retracted. Section line 13-13 is taken through both active and passive bolt springs 8 and 9, respectively.

Figure 13:
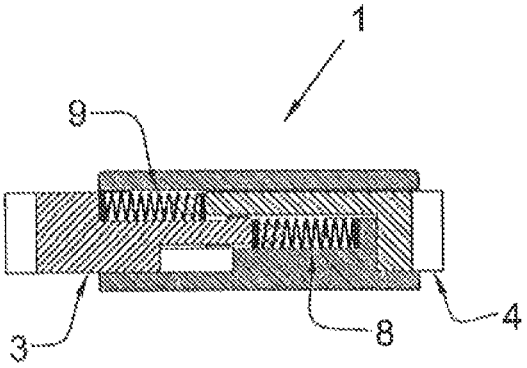
FIG. 13 is a section view of the presently disclosed latch module taken along section line 13-13 (through both the passive and active bolt springs) in FIG. 12, and illustrating internal components of such exemplary presently disclosed latch module, with the active and passive bolts and springs in their neutral state and with both springs expanded.

FIG. 13 is a section view taken along section line 13-13 of FIG. 12. The mechanism is in its neutral state and therefore the active and passive bolt springs 8 and 9 are shown extended.

Figure 14:
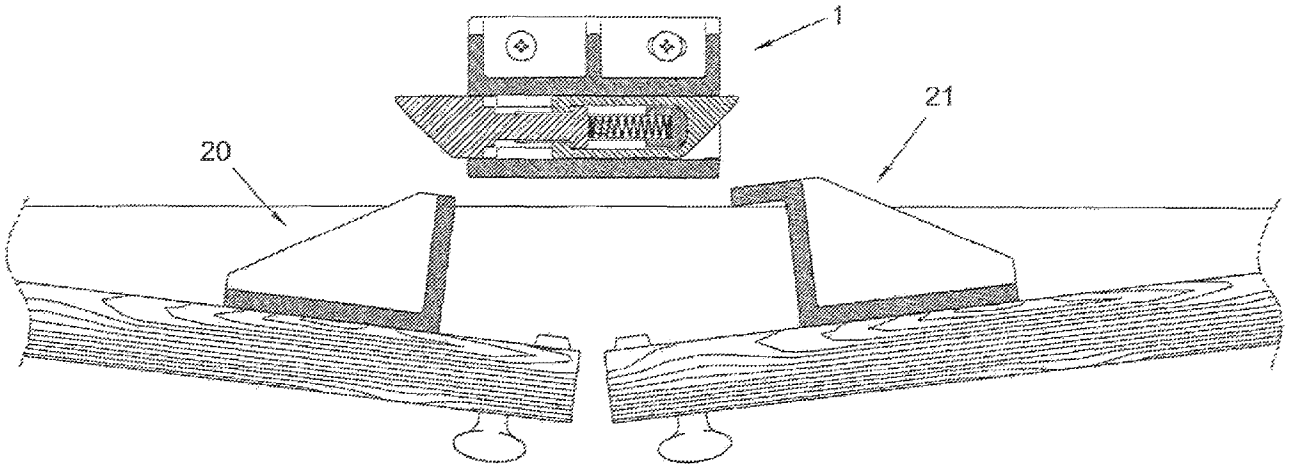
FIG. 14 is a section view taken along section line 9-9 in FIG. 7, showing one embodiment of presently disclosed subject matter installed in a cabinet, with both cabinet doors in an open position thereof.

FIG. 14 is a section view taken along section line 9-9 in FIG. 7. The respective associated cabinet doors 30 and 31 are shown open, and the latch module 1 is in its neutral state.

Figure 15:
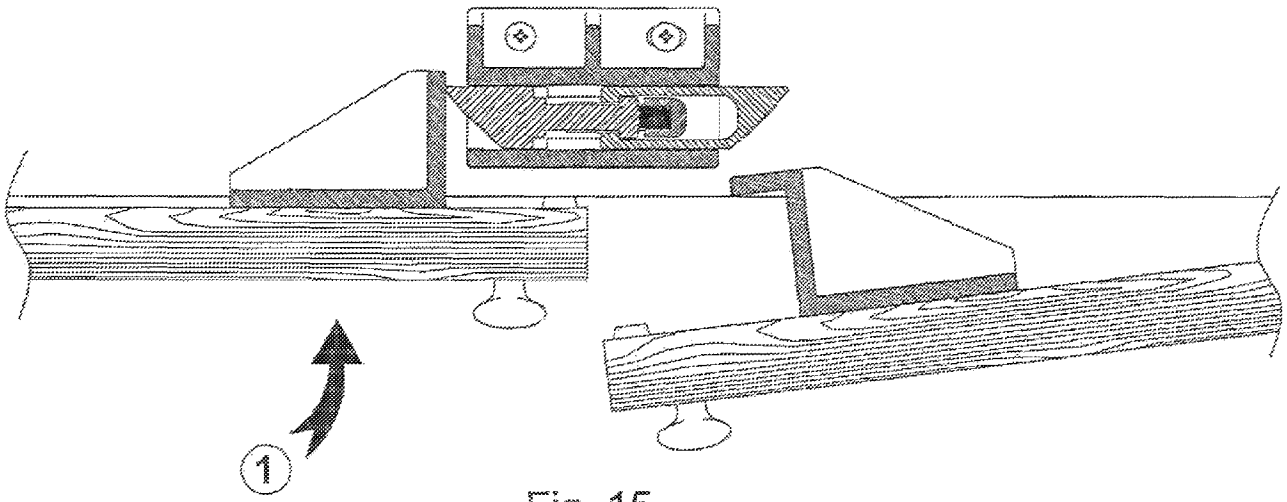
FIGS. 15, 16 and 17 are respective section views taken along either of section line 8-8 and 9-9 in FIG. 7, showing one of three different sequences by which the representative associated cabinet doors can be closed per presently disclosed subject matter, to activate the latching module, with the illustrated left door closed first and the illustrated right door closed second.
Figure 16:
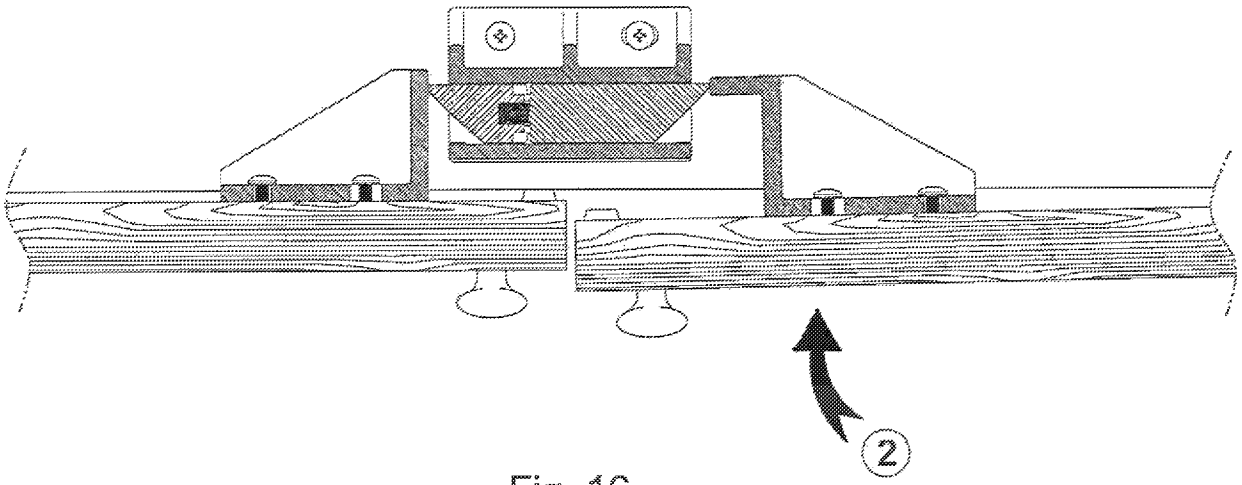
Figure 17:
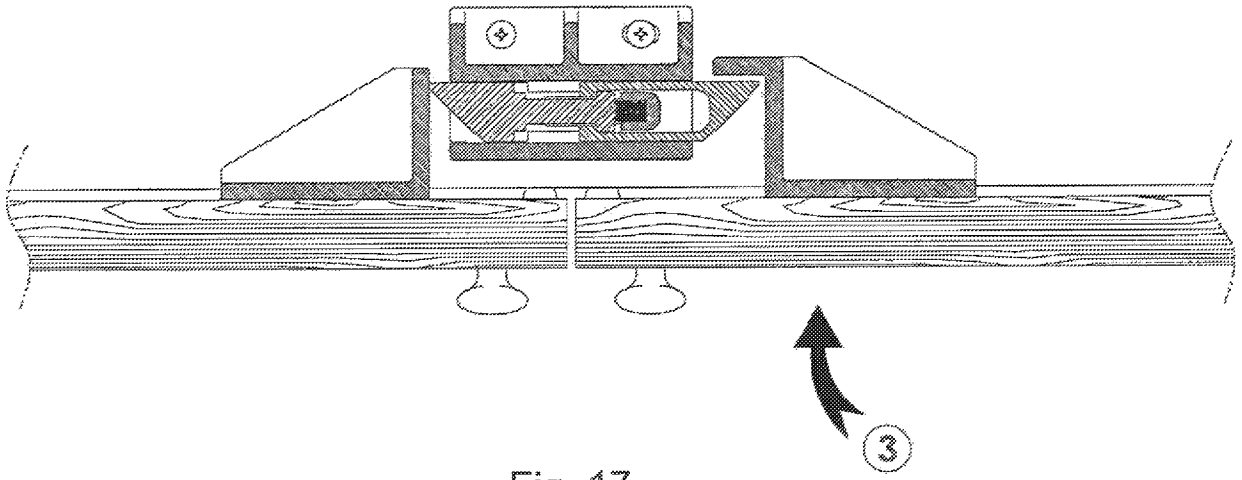

FIGS. 15, 16, and 17 are respective section views taken along section lines 8-8 and 9-9 in FIG. 7, showing one of three sequences by which the respective cabinet doors 30 and 31 can be closed to activate the latching module 1. In the illustrated sequence, the left door 30 is closed first and then the right door 31 is closed, as represented by the positions and progressive illustrations associated with encircled steps 1, 2, and 3 therein.

Figure 18:
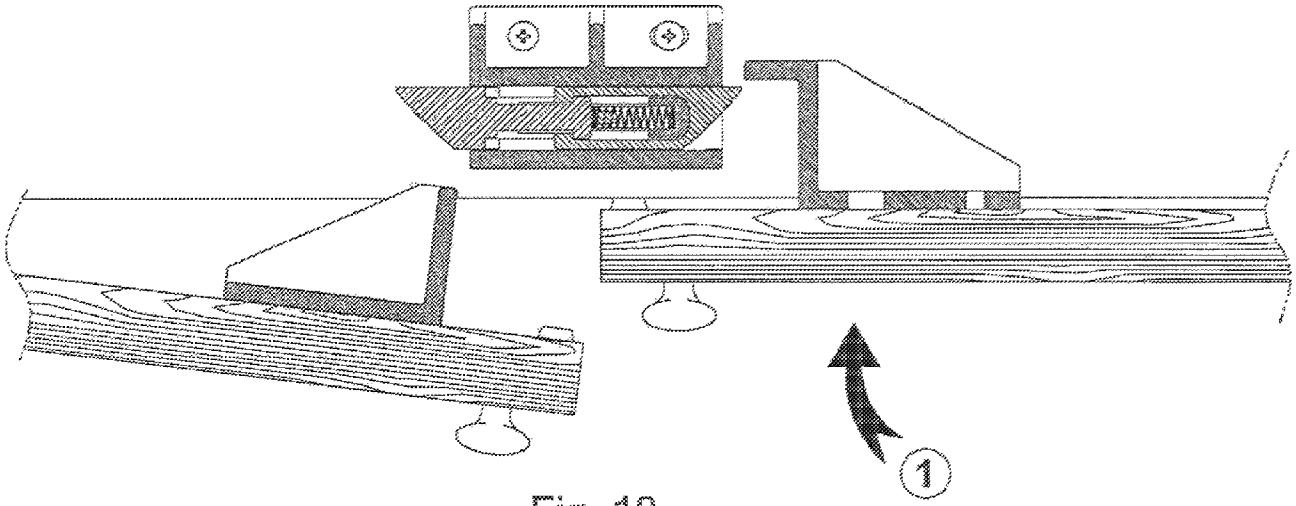
FIGS. 18 and 19 are respective section views taken along section line 9-9 in FIG. 7, showing a second possible sequence per presently disclosed subject matter by which the representative associated cabinet doors can be closed to activate the latching module, with the illustrated right door closed first and the illustrated left door closed second.
Figure 19:
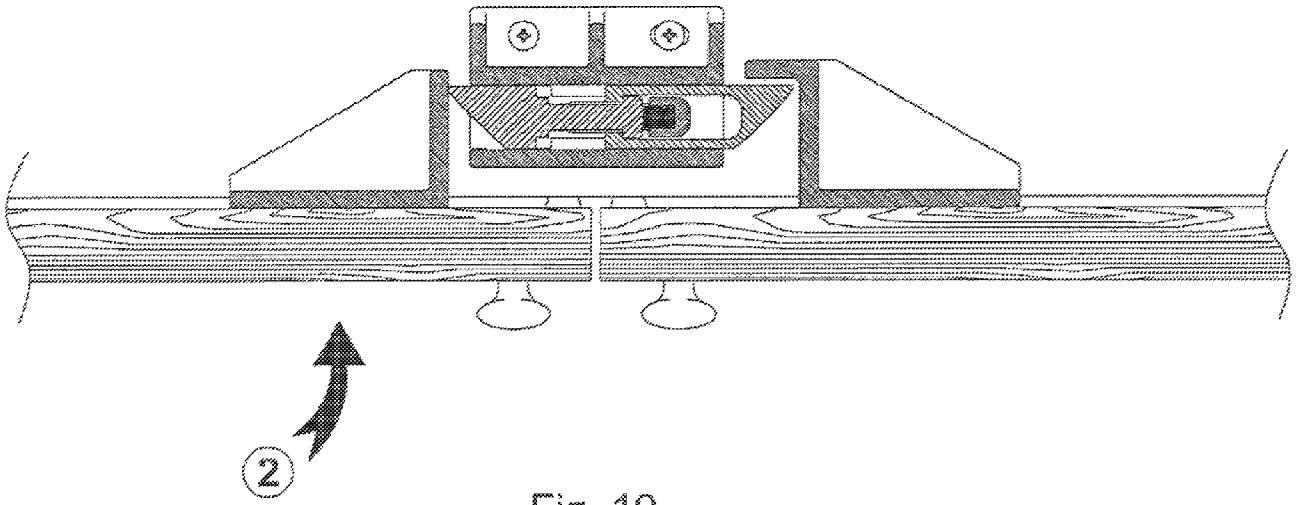

FIGS. 18 and 19 are section views taken along section line 9-9 in FIG. 7, showing a second possible sequence by which the respective cabinet doors 30 and 31 can be closed per presently disclosed subject matter to activate the latching module 1. In the illustrated sequence, the right door 31 is closed first and then the left door 30 is closed, as represented by the positions and progressive illustrations associated with encircled steps 1 and 2 therein.

Figure 20:
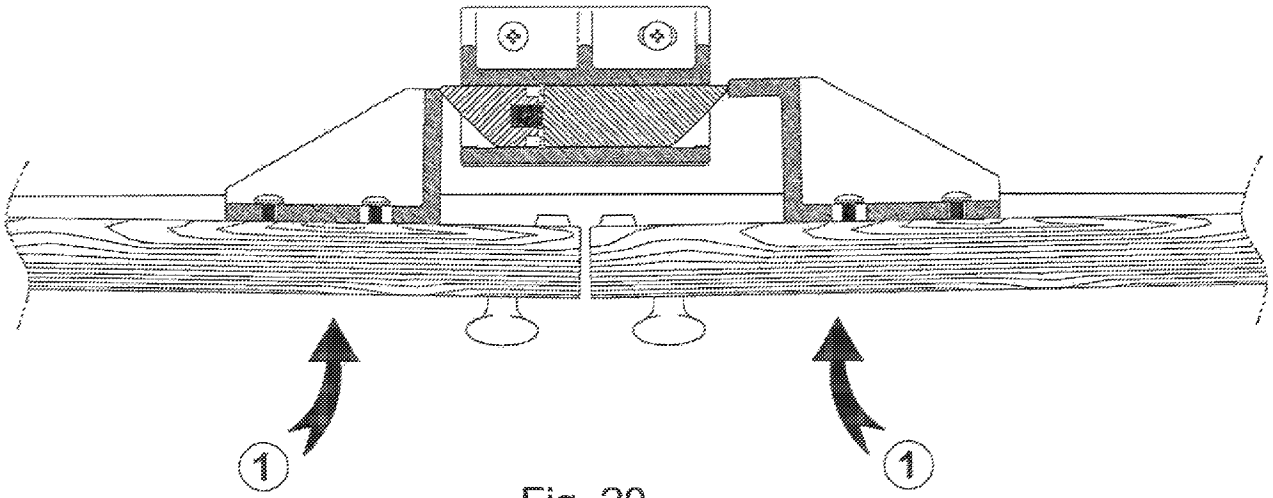
FIGS. 20 and 21 are respective section views taken along either of section line 8-8 and 9-9 in FIG. 7, showing a third possible sequence per presently disclosed subject matter by which the representative associated cabinet doors can be closed to activate the latching module, with both illustrated doors closed simultaneously.
Figure 21:
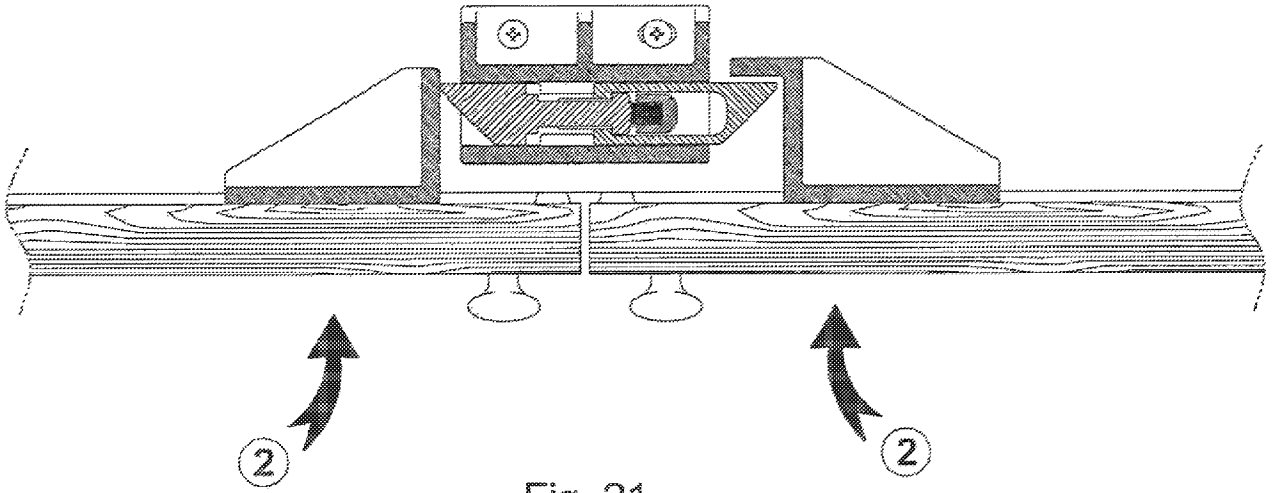

FIGS. 20 and 21 are section views taken along section lines 8-8 and 9-9 in FIG. 7, showing a third possible sequence per presently disclosed subject matter by which the respective cabinet doors 30 and 31 can be closed to activate the latching module 1. In the illustrated sequence, both doors 30 and 31 are closed simultaneously, as represented by the positions and progressive illustrations associated with encircled steps 1 and 2 therein.

Figure 22:
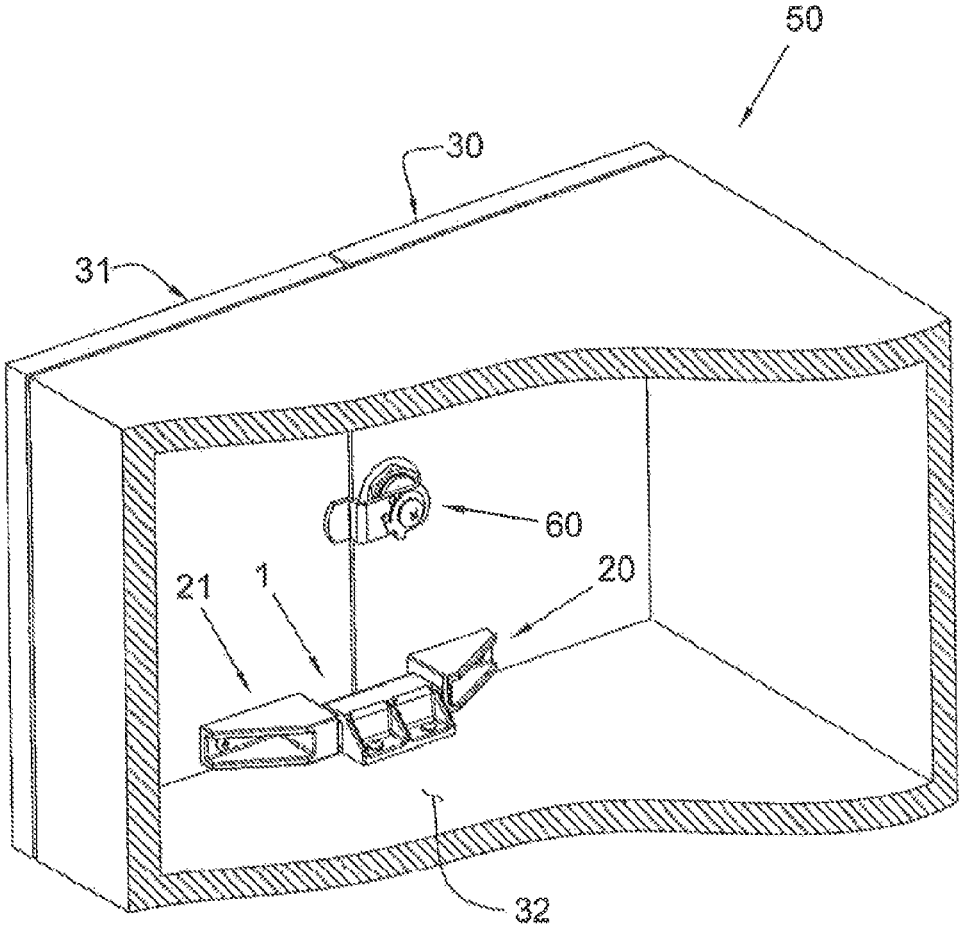
FIG. 22 is a partial cutaway perspective view showing an exemplary presently disclosed latch assembly mounted in a representative associated cabinet with a prior art cam lock in the center of the cabinet, configured so that such cam lock is mounted on the same side as the presently disclosed active bolt, such that the presently disclosed passive bolt latches the illustrated associated right door to the cabinet frame and the lock locks the illustrated associated left door to the right door.

FIG. 22 is a cutaway perspective view showing the latch module 1, pusher 20, and catch 21 mounted in a cabinet 50 with a prior art cam lock 60 in the center of the cabinet 50. The cam lock 60 is mounted on the same side as the active bolt 3. In the shown configuration, the passive bolt 4 latches the right door 31 to the cabinet frame 32 and the lock 60 locks the left door 30 to the right door 31.

Figure 23:
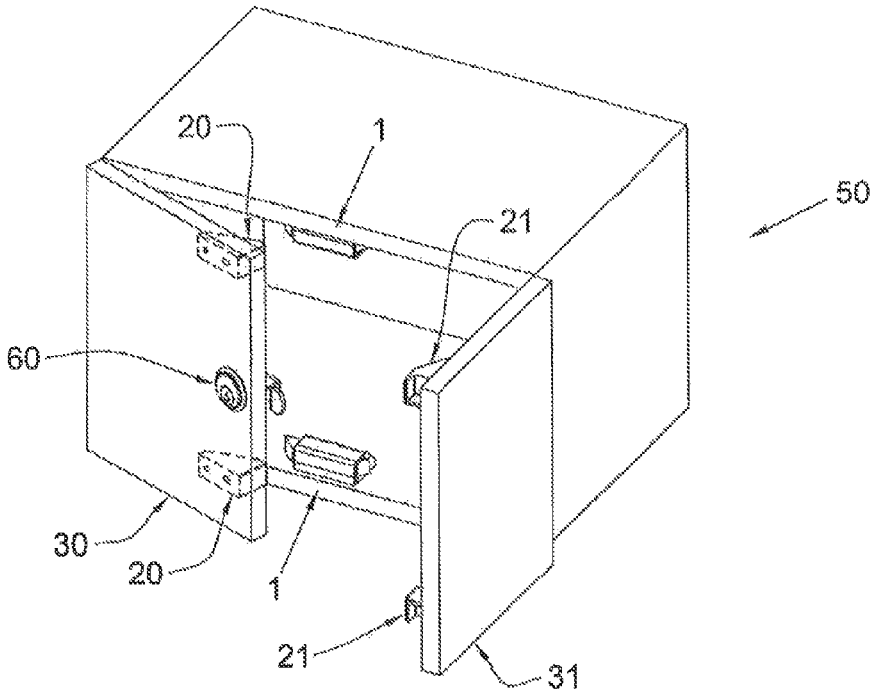
FIGS. 23 and 24 are perspective views showing an exemplary application whereby two sets of presently disclosed latch assemblies are installed in both the top and bottom of a cabinet, and in left-hand configuration and right-hand configuration, respectively.
Figure 24:
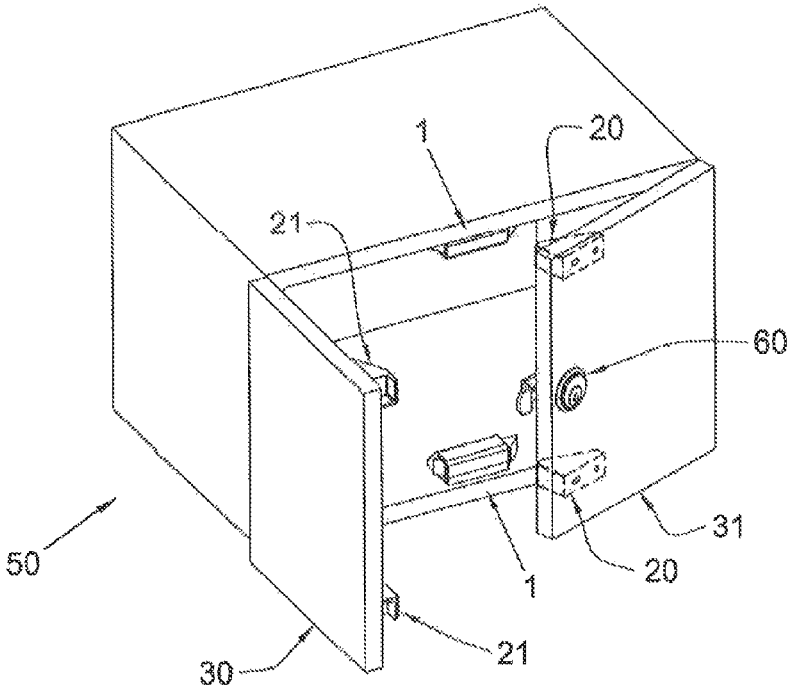

FIGS. 23 and 24 are perspective views showing an exemplary application whereby two sets of presently disclosed latch assemblies are installed in both the top and bottom of the cabinet 50, and in left-hand configuration and right-hand configuration. Since the latch module 1 could be installed at the top or the bottom of the cabinet 50 (with the side of the active bolt 3 reversed), and depending onto which door lock 60 is mounted, the active bolt 3 will need to be mirrored. As a result, there are multiple combinations that require two different, mirror image latch modules 1. Therefore, rather than calling such latch modules left-hand and right-hand, they are herein referred to as "type A" and "type B" latch modules 1. Using such nomenclature, FIG. 23 shows a cabinet 50 with a lock 60 on the left-hand door 30. Therefore, combination #1 having a lock on the left and latch at bottom requires a "type A" latch module 1. Furthermore, in FIG. 23, where the application requires, combination #2 having a lock on the left and latch at top requires a "type B" latch module 1. FIG. 24 shows a cabinet 50 with a lock 60 on the right-hand door 31. Therefore, combination #3 having a lock on the right and latch at bottom requires a "type B" latch module 1, and furthermore, where the application requires, combination #4 having a lock on the right and latch at top requires a "type A" latch module 1. FIG. 25 is a table summing up the four combinations illustrated in FIGS. 23 and 24 and described above. A single tall cabinet may have both "type A" and "type B" latch modules (one at the top and the other at the bottom as shown in FIG. 25), comprising combinations #5 & #6.

While the presently disclosed subject matter has been described in detail with respect to specific embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the presently disclosed subject matter as would be readily apparent to one of ordinary skill in the art.

What is claimed is:

1. A latch assembly for multiple doors of an enclosure, comprising:

a pusher engagement member for mounting on a first associated door of an associated enclosure;

a catch engagement member for mounting on a second associated door of an associated enclosure;

a housing defining an interior chamber along an elongated axis of such housing; and a pair of sliding spring-loaded bolts comprising respective bolt and spring pairs received in axial alignment for slide movement in such interior chamber with said bolts in partially nested position, such that an active bolt of such pair of bolts engages and pushes outwardly away from said housing a passive bolt of such pair of bolts whenever said active bolt is engaged by said pusher engagement member for relatively inward movement of such active bolt relative to said housing, so that said passive bolt is in a relatively extended position relative to said housing to engage said catch engagement member whenever the second associated door of the associated enclosure is in a closed position.

2. A latch assembly as in claim 1, wherein said passive bolt is mounted for inward sliding movement along said interior chamber relative to said housing whenever said passive bolt is engaged by said catch engagement member, without moving said active bolt.

3. A latch assembly as in claim 1, wherein:

said interior chamber comprises a u-shaped channel formed by said housing; and said latch assembly further includes a cap plate for selectively enclosing said u-shaped channel for maintaining said springs and inward ends of said bolts in said interior chamber.

4. A latch assembly as in claim 1, wherein:

said bolts have respective outward ends forming angled surfaces for contact with said engagement members for respectively being driven by said engagement members in an inward direction relative to said housing; and said bolts have respective inward ends forming pins disposed for securing respective ends of their paired springs.

5. A latch assembly as in claim 1, further comprising a pair of mating stop members formed respectively on said active bolt and said passive bolt for limiting the range of inward movement of said active bolt.

6. A latch assembly as in claim 1, further comprising a pair of cradles formed in said interior chamber for respectively receiving said pair of springs in parallel, non-axial alignment.

7. A latch assembly as in claim 1, further including a lock for mounting relative to the associated enclosure for locking the first and second associated doors whenever such doors are closed.

8. A latch assembly as in claim 1, wherein:

said interior chamber comprises a u-shaped channel formed by said housing, with said passive bolt mounted therein for inward sliding movement along said interior chamber relative to said housing whenever said passive bolt is engaged by said catch engagement member, without moving said active bolt;

said bolts have respective outward ends forming angled surfaces for contact with said engagement members for respectively being driven by said engagement members in an inward direction relative to said housing; and said bolts have respective inward ends forming pins disposed for securing respective ends of their paired springs; and said latch assembly further includes a cap plate for selectively enclosing said u-shaped channel for maintaining said springs and inward ends of said bolts in said interior chamber;

a pair of mating stop members formed respectively on said active bolt and said passive bolt for limiting the range of inward movement of said active bolt; and a pair of cradles formed in said interior chamber for respectively receiving said pair of springs in parallel, non-axial alignment.

9. A latch assembly for mounting on a cabinet having at least respective paired first and second doors, comprising:

respective pusher and catch members for respective mounting on said first and second doors of a cabinet; and a latch module for mounting on said cabinet between said pusher and catch members, said latch module having a housing defining an interior chamber along an elongated axis of such housing, and having a pair of slam bolts received in said interior chamber for respective closing engagement of said bolts depressed into said latch module housing whenever respectively engaged by said pusher and catch members;

wherein said bolts are partially nested relative to each other so that depressing one bolt into said latch housing extends the other bolt out of the opposite side of the latch module housing while depressing such other bolt into said latch housing passes by the one bolt without changing position of such one bolt in such latch module housing.

10. A latch assembly as in claim 9, further comprising a pair of mating stop members formed respectively on said bolts for limiting the range of depressing movement of such one bolt into said latch module housing.

11. A latch assembly as in claim 9, wherein said slam bolts are respectively associated with springs received within said latch module housing.

12. A latch assembly as in claim 11, further comprising:

a u-shaped channel formed by said latch module housing and forming said interior chamber thereof; and said latch assembly further includes a cap plate for selectively closing said u-shaped channel for maintaining said springs and inward ends of said bolts in said interior chamber.

13. A latch assembly as in claim 11, wherein:

said bolts have respective outward ends forming angled surfaces for contact with said pusher and catch members for respectively being depressed by said pusher and catch members into said latch module housing; and said bolts have respective inward ends forming pins disposed for securing respective ends of their associated springs.

14. A latch assembly as in claim 11, further comprising a pair of cradles formed in said interior chamber for respectively receiving said pair of springs in parallel, non-axial alignment.

15. A latch assembly as in claim 9, further including a lock for mounting relative to the associated enclosure for locking the first and second associated doors whenever such doors are closed.

16. A latch assembly as in claim 9, further including:

a second set of respective pusher and catch members for respective mounting on said first and second doors; and a second latch module for mounting on said cabinet between said second set of respective pusher and catch members.

* * * * *